US008547238B2

(12) United States Patent
Harchanko

(10) Patent No.: US 8,547,238 B2
(45) Date of Patent: Oct. 1, 2013

(54) OPTICALLY REDUNDANT FIRE DETECTOR FOR FALSE ALARM REJECTION

(75) Inventor: John Harchanko, New Market, AL (US)

(73) Assignee: KnowFlame, Inc., Huntsville, AL (US)

( * ) Notice: Subject to any disclaimer, the term of this patent is extended or adjusted under 35 U.S.C. 154(b) by 326 days.

(21) Appl. No.: 12/827,757

(22) Filed: Jun. 30, 2010

(65) Prior Publication Data

US 2012/0001760 A1 Jan. 5, 2012

(51) Int. Cl.
*G08B 17/12* (2006.01)

(52) U.S. Cl.
USPC ..... 340/578; 340/286.05; 340/426.13; 340/426.24; 340/426.25; 340/438; 340/443; 340/447; 340/449; 340/557; 340/587; 340/628

(58) Field of Classification Search
USPC ..... 340/286.05, 426.13, 426.24, 426.25, 340/438, 443, 447, 449, 557, 578, 587, 628
See application file for complete search history.

(56) References Cited

U.S. PATENT DOCUMENTS

| | | | | | |
|---|---|---|---|---|---|
| 3,255,352 | A | * | 6/1966 | Johnston | 250/303 |
| 3,741,309 | A | * | 6/1973 | McCulloch | 169/59 |
| 4,097,851 | A | * | 6/1978 | Klein | 340/628 |
| 4,151,522 | A | * | 4/1979 | Yamauchi | 340/587 |
| 4,647,785 | A | * | 3/1987 | Morita | 250/574 |
| 4,691,196 | A | * | 9/1987 | Kern et al. | 340/578 |
| 4,697,172 | A | * | 9/1987 | Kimura | 340/587 |
| 4,701,624 | A | * | 10/1987 | Kern et al. | 250/554 |
| 4,749,987 | A | * | 6/1988 | Ishii | 340/587 |
| 4,764,758 | A | * | 8/1988 | Skala | 340/627 |
| 4,803,469 | A | * | 2/1989 | Matsushita | 340/577 |
| 4,866,420 | A | * | 9/1989 | Meyer, Jr. | 340/578 |
| 4,871,999 | A | * | 10/1989 | Ishii et al. | 340/587 |
| 4,963,856 | A | * | 10/1990 | Yukitomo | 340/426.25 |
| 4,965,453 | A | * | 10/1990 | Hoschette et al. | 250/349 |
| 5,153,563 | A | * | 10/1992 | Goto et al. | 340/578 |
| 5,237,512 | A | * | 8/1993 | Davidson | 702/73 |
| 5,311,167 | A | * | 5/1994 | Plimpton et al. | 340/578 |
| 5,373,159 | A | * | 12/1994 | Goldenberg et al. | 250/339.15 |
| 5,497,003 | A | * | 3/1996 | Baliga et al. | 250/338.3 |
| 5,552,763 | A | * | 9/1996 | Kirby | 340/506 |
| 5,592,147 | A | * | 1/1997 | Wong | 340/522 |

(Continued)

FOREIGN PATENT DOCUMENTS

| | | | | |
|---|---|---|---|---|
| EP | 588753 | A1 | * | 3/1994 |
| JP | 10221163 | A | * | 8/1998 |
| JP | 2004005754 | A | * | 1/2004 |

*Primary Examiner* — George Bugg
*Assistant Examiner* — Paul Obiniyi
(74) *Attorney, Agent, or Firm* — C. Brandon Browning; Maynard, Cooper & Gale, PC

(57) ABSTRACT

A system for confirming the detection of a fire using a plurality of radiation or flame sensors each equipped with a radiation detector and an optical filter having a spectral transmission characteristic in which at least one optical filter is redundant to at least one other optical filter. The result is a system having operationally redundant sensors. In use, if a fire is detected by one of the redundant sensors without including the other redundant radiation sensor in the fire detection calculation, then a fire detection algorithm can switch to the other operationally redundant sensor to check for confirmation of a fire. Due to the spatial separation and if the object is small and close, a different result will be obtained with the redundant detector being used in the calculation compared to the primary detector that is associated with the redundant detector.

21 Claims, 4 Drawing Sheets

(56) References Cited

U.S. PATENT DOCUMENTS 5,594,417 A * 1/1997 Morita ..... 340/506
5,612,537 A * 3/1997 Maynard et al. ..... 250/339.15
5,625,342 A * 4/1997 Hall et al. ..... 340/578
5,691,703 A * 11/1997 Roby et al. ..... 340/628
5,691,704 A * 11/1997 Wong ..... 340/628
5,696,503 A * 12/1997 Nasburg ..... 340/933
5,767,776 A * 6/1998 Wong ..... 340/632
5,798,700 A * 8/1998 Wong ..... 340/628
5,804,825 A * 9/1998 Schuler ..... 250/339.15
5,838,242 A * 11/1998 Marsden ..... 340/628
5,850,182 A * 12/1998 Schuler ..... 340/578
5,936,531 A * 8/1999 Powers ..... 340/628
5,949,235 A * 9/1999 Castleman et al. ..... 324/509
5,966,077 A * 10/1999 Wong ..... 340/630
5,995,008 A * 11/1999 King et al. ..... 340/578
6,031,223 A * 2/2000 Morishita ..... 250/231.13
6,046,452 A * 4/2000 Castleman et al. ..... 250/339.15
6,057,549 A * 5/2000 Castleman ..... 250/339.15
6,064,064 A * 5/2000 Castleman ..... 250/339.15
6,071,114 A * 6/2000 Cusack et al. ..... 431/79
6,078,050 A * 6/2000 Castleman ..... 250/339.15
6,135,760 A * 10/2000 Cusack et al. ..... 431/79
6,147,598 A * 11/2000 Murphy et al. ..... 340/426.19
6,150,659 A * 11/2000 Baliga et al. ..... 250/339.15
6,153,881 A * 11/2000 Castleman ..... 250/339.15
6,166,647 A * 12/2000 Wong ..... 340/628
6,239,435 B1 * 5/2001 Castleman ..... 250/339.15
6,373,393 B1 * 4/2002 Matsukuma et al. ..... 340/578
6,448,888 B1 * 9/2002 Horner et al. ..... 340/425.5
6,518,574 B1 * 2/2003 Castleman ..... 250/339.15
6,677,590 B2 * 1/2004 Nakauchi et al. ..... 250/339.15
6,727,511 B2 * 4/2004 Cusick et al. ..... 250/559.29
6,856,252 B2 * 2/2005 Pfefferseder et al. ..... 340/628
6,927,394 B2 * 8/2005 Parham et al. ..... 250/339.15
7,009,497 B2 * 3/2006 Nicoletti et al. ..... 340/286.05
7,119,697 B2 * 10/2006 King ..... 340/578
7,319,228 B2 * 1/2008 Zhevelev et al. ..... 250/339.02
7,327,247 B2 * 2/2008 Tice ..... 340/511
7,408,453 B2 * 8/2008 Breed ..... 340/442
7,421,321 B2 * 9/2008 Breed et al. ..... 701/33.6
7,504,633 B2 * 3/2009 Zhevelev et al. ..... 250/353
7,542,522 B2 * 6/2009 Ross et al. ..... 375/316
7,551,096 B2 * 6/2009 Tice ..... 340/630
7,573,032 B2 * 8/2009 Zhevelev et al. ..... 250/339.14
7,580,782 B2 * 8/2009 Breed et al. ..... 701/45
7,603,894 B2 * 10/2009 Breed ..... 73/146
7,638,770 B2 * 12/2009 Serero et al. ..... 250/339.15
7,642,924 B2 * 1/2010 Andres et al. ..... 340/628
7,663,502 B2 * 2/2010 Breed ..... 340/12.25
7,684,029 B2 * 3/2010 Tan et al. ..... 356/221
7,705,310 B2 * 4/2010 Zhevelev et al. ..... 250/339.02
7,760,080 B2 * 7/2010 Breed et al. ..... 340/447
7,786,864 B1 * 8/2010 Shostak et al. ..... 340/572.1
7,786,877 B2 * 8/2010 Hou ..... 340/578
7,880,594 B2 * 2/2011 Breed et al. ..... 340/425.5
7,889,096 B2 * 2/2011 Breed ..... 340/12.51
7,920,102 B2 * 4/2011 Breed ..... 345/7
7,969,296 B1 * 6/2011 Stell ..... 340/522
7,991,187 B2 * 8/2011 Hou ..... 382/100
8,077,046 B1 * 12/2011 Wong ..... 340/577
8,138,478 B2 * 3/2012 Zhevelev et al. ..... 250/349
8,169,311 B1 * 5/2012 Breed ..... 340/438
2002/0011570 A1 * 1/2002 Castleman ..... 250/339.15
2002/0139942 A1 * 10/2002 Cusick et al. ..... 250/559.29
2002/0174367 A1 * 11/2002 Kimmel et al. ..... 713/201
2003/0009270 A1 * 1/2003 Breed ..... 701/29
2003/0174056 A1 * 9/2003 Harshaw ..... 340/522
2003/0214583 A1 * 11/2003 Sadok ..... 348/143
2004/0130442 A1 * 7/2004 Breed et al. ..... 340/443
2004/0183667 A1 * 9/2004 Nicoletti et al. ..... 340/506
2004/0216895 A1 * 11/2004 Boyce et al. ..... 169/5
2005/0012626 A1 * 1/2005 Owrutsky et al. ..... 340/578
2005/0125117 A1 * 6/2005 Breed ..... 701/29
2005/0195086 A1 * 9/2005 King ..... 340/578
2006/0176169 A1 * 8/2006 Doolin et al. ..... 340/521
2006/0244581 A1 * 11/2006 Breed et al. ..... 340/447
2007/0000711 A1 * 1/2007 Yamaguchi et al. ..... 180/274
2007/0018106 A1 * 1/2007 Zhevelev et al. ..... 250/353
2007/0029486 A1 * 2/2007 Zhevelev et al. ..... 250/339.02
2007/0057781 A1 * 3/2007 Breed ..... 340/457.1
2007/0126561 A1 * 6/2007 Breed ..... 340/426.13
2007/0139216 A1 * 6/2007 Breed ..... 340/825.72
2007/0145277 A1 * 6/2007 Zhevelev et al. ..... 250/353
2007/0152156 A1 * 7/2007 Zhevelev et al. ..... 250/339.14
2007/0205881 A1 * 9/2007 Breed ..... 340/447
2008/0030352 A1 * 2/2008 Shaw ..... 340/579
2008/0036593 A1 * 2/2008 Rose-Pehrsson et al. ..... 340/540
2008/0042410 A1 * 2/2008 Breed et al. ..... 280/735
2008/0061984 A1 * 3/2008 Breed et al. ..... 340/572.7
2008/0129475 A1 * 6/2008 Breed et al. ..... 340/438
2008/0230701 A1 * 9/2008 Serero et al. ..... 250/339.15
2009/0014654 A1 * 1/2009 Zhevelev et al. ..... 250/339.02
2009/0146063 A1 * 6/2009 Zhevelev et al. ..... 250/349
2009/0315722 A1 * 12/2009 Hou ..... 340/578
2010/0013619 A1 * 1/2010 Zimmer ..... 340/449
2010/0085199 A1 * 4/2010 Gonzales ..... 340/629
2010/0207754 A1 * 8/2010 Shostak et al. ..... 340/450
2010/0283626 A1 * 11/2010 Breed ..... 340/825.49
2011/0018726 A1 * 1/2011 Gonzales ..... 340/628
2011/0304728 A1 * 12/2011 Owrutsky et al. ..... 348/135
2012/0001760 A1 * 1/2012 Harchanko ..... 340/578

* cited by examiner

OPTICALLY REDUNDANT FIRE DETECTOR FOR FALSE ALARM REJECTION

FIELD OF THE INVENTION

The present invention is generally directed to a system and method for confirming the detection of a fire in a monitored region. More particularly, the present invention is directed to a fire detection system including an operationally redundant flame sensor and logic for discriminating between a fire event and a false fire event in a monitored region.

BACKGROUND OF THE INVENTION

Optical fire detection systems including multiple flame sensors are known in the art. Exemplary systems are described in U.S. Pat. Nos. 6,518,574, 5,373,159, 5,311,167, 5,995,008 and 5,497,003. The flame sensors in such systems are typically equipped with a radiation detector and a unique optical filter that ranges from the ultraviolet to the infrared to allow for the measurement of the spectral content of objects within the flame sensor's field of view (FOV). By judiciously choosing the type of radiation detector, e.g., a Geiger-Mueller, a silicon, a pyroelectric, etc., in combination with the appropriately-specified optical filter for each radiation detector and electronically combining the output signals from the flame sensors, a flame can be discriminated from other innocuous sources. In this manner, based on the emissive characteristics of a flame and the anticipated false fire alarm sources, e.g., a radiant heater, cigarette, cigar, etc., within a monitored region a fire detection system can be developed by selecting the appropriate combination of radiation detectors and optical filters so that the anticipated false alarm sources does not cause a false alarm. In fire detection systems of this type, a fire alarm condition is identified and reported by the system when the sensed source of radiation appears to be spectrally similar to a flame as defined by the system designer and determined by the designer's choice of radiation detectors, optical filters and electronic combination of the resulting signals from the radiation detectors.

A shortcoming of optical fire detection systems of this type is manifested when a spatially small source of radiation is brought in close proximity to the flame sensors. That is because there is an inherent spatial disparity between the multiple flame sensors. This spatial disparity often results from the use of the discrete radiation detectors and can be directly measurable as a physical distance. Alternatively, this spatial disparity can result from the use of refractive, diffractive or reflective optical elements.

In particular, the radiation detector of each flame sensor has its own field of view that may not significantly overlap with that of an adjacent radiation detector until an object is several inches away from the radiation detector. If the spatially small radiation source is brought closer than the common field range of the radiation detectors, i.e., the range at which FOV of the radiation detectors overlap, a significant chance exists that one detector will observe more of the radiation source than any other radiation detector. As a result, the radiation detector that observed more of the radiation will have the chance to collect more radiation from the radiation source depending on the spectral characteristics of the radiation source and the optical filter associated with that particular radiation detector. Consequently, the electronic output from the flame sensor including that particular radiation detector could be skewed relative to the other flame sensors. Once received and analyzed, the information transmitted in the electronic output of that flame sensor could cause the fire detection system to trigger a false alarm.

SUMMARY OF THE INVENTION

The present invention is directed to a system for confirming the detection of a fire using a fire detection system having a plurality of flame sensors each equipped with a radiation detector and an optical filter having a spectral transmission characteristic in which at least one optical filter is redundant to at least one other optical filter. The present invention is further directed to a method for testing for the condition in which a spatially small source of radiation is in close proximity to a flame detector so that the multiple radiation sensors of the detector each view different spatial extents of the object so that a false alarm is avoided. As such, the present invention is particularly suited for detecting fires where low false alarms rates are required and the distance and size of the fire varies over a wide range.

According to one aspect of the invention there is disclosed a system for discriminating between a fire event and a false fire event. The system includes a first radiation detecting structure configured for transmitting a first signal and a second radiation detecting structure being operationally redundant to the first radiation detecting structure and configured for transmitting a second signal. A computer-based processor is provided for receiving and analyzing the first signal and at least one other signal for producing a first output, and comparing the first output to a predetermined fire condition for determining whether the first output indicates a fire. The computer-based process is further configured for receiving and analyzing the second signal and the at least one other signal for producing a second output, and comparing the first output to the second output. In the event the first output and the second output satisfy a predetermined criteria for similarity or the presence of fire, a fire alarm command signal is transmitted to a fire extinguishing system for extinguishing the fire. However, if the first and second output are not sufficiently similar or they do not meet the predetermined fire-presence criteria, the system will not transmit the fire alarm command signal, even if the first output indicates the presence of a fire event.

According to another aspect of the invention, there is disclosed a method for discriminating between a fire event and a false fire event in a monitored region. The method includes positioning a plurality of flame sensors within the monitored region, wherein the plurality of flame sensors includes at least a first radiation sensor and a second radiation sensor that is operationally redundant to the first radiation sensor. Upon detection by the plurality of radiation sensors of a potential fire event, the plurality of flame sensors transmit signals to a computer based processor. The processor calculates a first output and a second output based upon the signals. The first output is calculated using a first signal transmitted by the first sensor absent a second signal transmitted by the second sensor. The second output is calculated using the second signal absent the first signal. In the event the first output indicates a fire event, the first output and the second output are compared to one another for similarity. If the first and second output are not sufficiently similar, the first output is ignored and no fire alarm command is transmitted to a fire extinguishing system. On the other hand, if the first output indicates a fire event and the first and second outputs are sufficiently similar, the fire alarm command is sent to the fire extinguishing system, and the fire is extinguished.

According to yet another aspect of the invention, there is disclosed a method of making a system for discriminating between a fire event and a false fire event. The method includes operatively coupling a plurality of radiation sensors to a computer based processor, and configuring a first radiation sensor of the plurality of radiation sensors to be operationally redundant to a second radiation sensor of the plurality of radiation sensors. The method further includes configuring the computer based processor for receiving and analyzing signals generated by the plurality of radiation sensors upon detection thereby of a potential fire event, calculating a first output using a first signal transmitted by the first sensor absent a second signal transmitted by the second sensor, and calculating a second output using the second signal absent the first signal. The processor is further configured for transmitting a fire alaan command signal to a fire extinguishing system when the first output and the second output satisfy a predetermined criteria for similarity or a predetermined fire-presence criteria.

DETAILED DESCRIPTION OF PRESENTLY PREFERRED EMBODIMENTS

A process and system for detecting sparks, flames or fire in accordance with a preferred embodiment of the present invention is described herein. It should be noted that the terms "fire sensor," "flame sensor" and "radiation sensor" " are used interchangeably in the present text and refer generally to any sensor for detecting sparks, flames, or fires, including explosive type fires or fireballs and other dangerous heat-energy phenomena.

A problem addressed by the present invention is that fire detection systems often produce inconsistent results for fires occurring at different points in the fields of view of the radiation detectors of the flame sensors of the system. This problem arises due to the interference filters employed with the radiation detectors to transmit radiation in the desired spectral bands. The passbands of the interference filters vary with the angle at which the radiation from a fire is incident on the filter. As a result, the amount of radiation sensed is dependent on the angle of incidence, and, in consequence, a particular flame sensor may not be as effective at detecting a fire when the fire is positioned off-axis from the radiation detector of the flame sensor. Thus, optical flame detection systems utilizing multiple radiation sensors including ultraviolet, visible and infrared radiation detectors, each equipped with unique optical filters for measuring the spectral signature of the objects in the field of view, work well at distances where the individual fields of view overlap. However, at close range, the fields of view do not overlap and one radiation detector may see more of the object than another.

Figure 1:
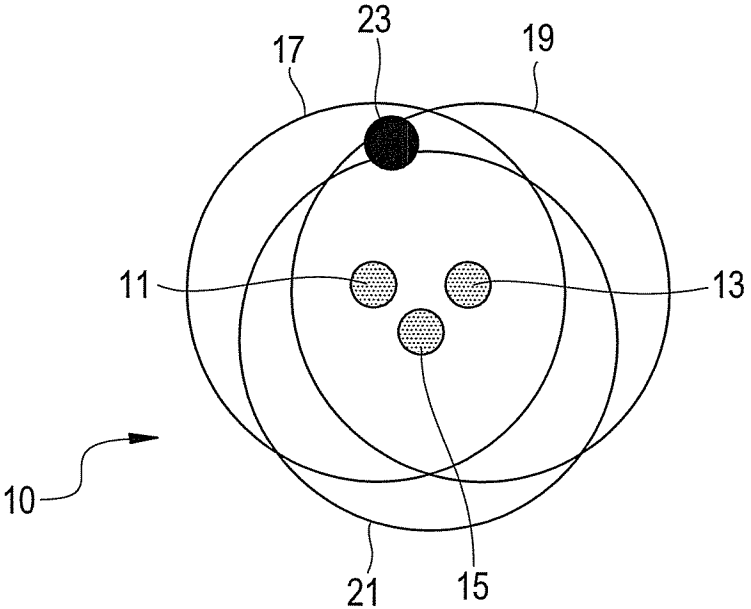
FIG. 1 is a partial sectional view of the fields of view of a prior art fire detection system having multiple flame sensors.

To illustrate this phenomenon, at FIG. 1 there is depicted a partial sectional view of the fields of view of a prior art flame detection system 10 at close range. Close range is anywhere between 0 and 6 inches depending on the proximity of the sensors to one another. Flame detection system 10 includes three unique radiation sensors 11, 13 and 15 that are configured to detect radiation in the ultraviolet, visible and the infrared portions of the electromagnetic spectrum, respectively. At close range, sensors 11, 13 and 15 exhibit respective fields of view 17, 19 and 21. At this range, when an object 23, such as a cigarette, is located within fields of view 17, 19 and 21, object 23 may be more thoroughly sensed by one sensor than another. Specifically, for example, in FIG. 1, object 23 is located completely within field of view 17 of sensor 11 but only partially located within the fields of view 19 and 21 of sensors 13 and 15. This skews the output of sensor 11 relative to sensors 13 and 15 since sensor 11 perceives object 23 to have a greater intensity than is perceived by sensors 13 and 15. Thus, even though the same object would not signal a false alarm at longer ranges where all of the radiation sensors can see the entire object within the fields of view of their radiation detectors, at closer ranges the output of some sensors would be skewed to the point where the object appears to be a fire.

To solve this problem, the present invention relies upon the addition of an operationally redundant flame sensor to the bank of sensors so that if a fire is detected without including the operationally redundant radiation sensor in the calculation, the algorithm can switch to the operationally redundant sensor to check for confirmation of a fire. Due to the spatial separation of the operationally redundant sensor and the mimicked sensor, and if the object is small and close, a different result will be obtained with the operationally redundant sensor being used in the calculation compared to the primary sensor that is associated with or mimicked by the operationally redundant sensor. Herein, by "operationally redundant sensor," "operationally redundant flame sensor" and "operationally redundant radiation sensor" it is meant a sensor that operates substantially similar to another sensor within the flame detection system, either as an exact copy or through manipulation of the sensor material, sensor temperature, sensor wavelength filter, sensor preamplifier, sampling mechanism (if so equipped), and/or the software algorithm (if so equipped) so that it could be used as an effective replacement of the other sensor, i.e., the mimicked sensor. Thus, the operationally redundant sensor can be identical in function and structure to the mimicked sensor or it can have a different detector material and a different filter so long as it is substantially similar in performance to the mimicked sensor. For example, many detector materials overlap when considering their spectral response so that a silicon photodetector—a visible spectrum sensor—equipped with a unique optical filter, and a thermopile detector—an infrared spectrum sensor—equipped with its own unique optical filter could be configured through preamplifiers, calibration and software gains to perform substantially similar to one another.

Figure 2:
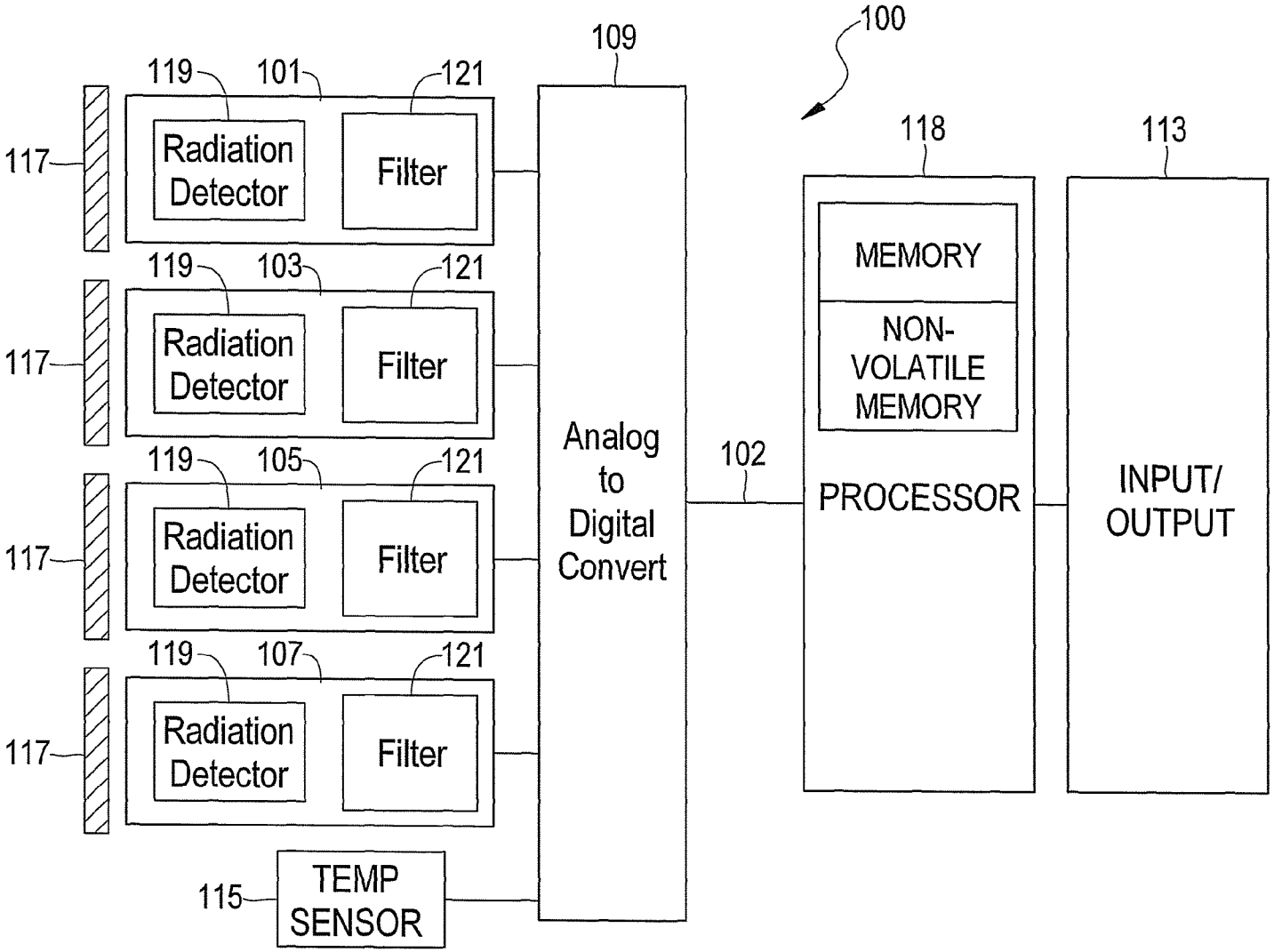
FIG. 2 illustrates a block diagram schematic of an optical detector apparatus for detecting the presence of fire in accordance with a preferred embodiment of the present invention.

Referring to FIG. 2, there is depicted a block diagram schematic of a flame detection apparatus 100 according to a presently preferred embodiment of the present invention. Apparatus 100 includes a plurality of optical flame sensors 101, 103, 105 and 107, all of which are coupled to an analog-to-digital converter, or ADC, 109 which is further coupled to a processor 111 for processing according to a detection algorithm executed by a computer program stored on computer-readable media accessible by the processor 111. The processor 111 is responsive to an input/output device 113 which may include any one of a keypad, a display, aural indicators, such as one or more speakers, and visual indicators, such as light-emitting diodes, or the like. A temperature sensor 115 may also be included to indicate ambient temperature values for calibration purposes. Sensors 101, 103, 105 and 107 may be configured with a dedicated amplifier to boost signal strength, as well as a transparent protective covering 117.

Optical sensors 101, 103, 105 and 107 each include a respective radiation detector 119 which can be selected, for example, from a Geiger-Mueller radiation detector, a silicon radiation, a pyroelectric radiation detector, a thermopile detector, a lead sulfide detector, a lead selenide detector, an indium antimonide detector, etc. Based on the emissive characteristics of a flame, the type of radiation detector 119 and the anticipated false fire alarm sources, an appropriately-specified optical filter 121 is combined with each radiation detector 119. Thus, for example, depending on the radiation detector type, each radiation detector 119 of sensors 101, 103, 105 and 107 can combined with an optical filter 121 selected from an ultraviolet band spectra filter, a visible band spectra filter, a near band infrared spectra filter, a mid band infrared spectra filter, a fax band infrared spectra filter, a water band spectra filter or a carbon dioxide band spectra filter. Preferably, sensors 101, 103, 105 are configured to detect radiation in the ultraviolet, visible and infrared portions of the electromagnetic spectrum, respectively. Sensor 107 is the operationally redundant sensor.

Figure 3:
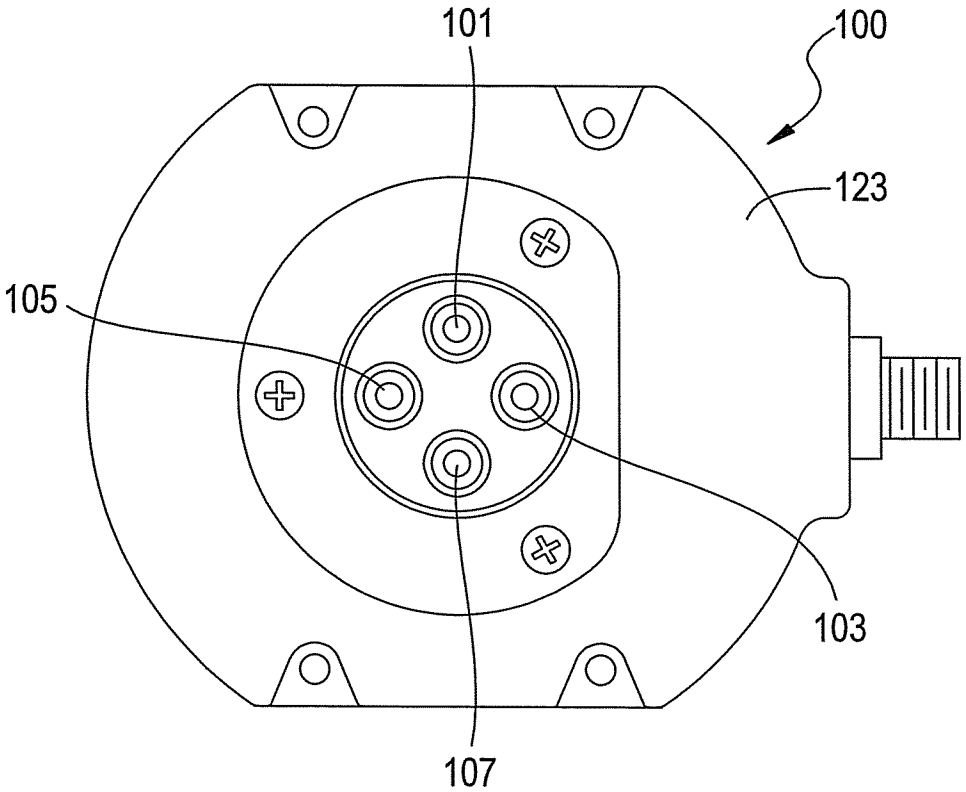
FIG. 3 is plan view of the optical detector apparatus of FIG. 2.

Referring to FIG. 3, flame detection apparatus 100 includes a dedicated enclosure 123, such as a TO-5 electronics package, within which sensors 101, 103, 105 and 107 are housed. To create a large spatial disparity for operationally redundant sensor 107 and the mimicked sensor within enclosure 123, the operationally redundant sensor is located farther from the mimicked radiation detector, which in the present embodiment is shown in FIG. 3 as sensor 101, than from sensors 103 and 105. By locating sensor 107 father away from sensor 101 than from sensors 103 and 105, the FOV of sensor 107 at close range overlaps the FOV of sensor 101 less than the FOVs of sensors 103 and 105.

Figure 4:
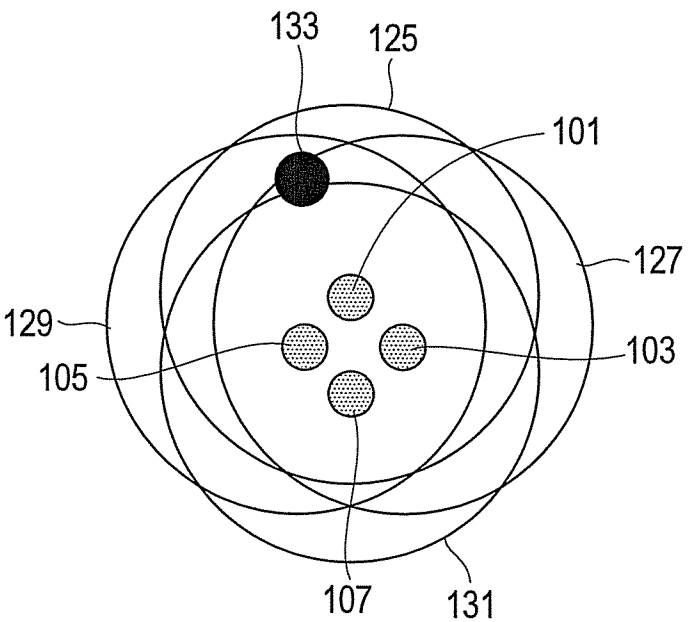
FIG. 4 is a partial sectional view of the fields of view of the flame sensors of the optical detector apparatus of FIG. 2.

To illustrate the spatial disparity of operationally redundant sensor 107 and mimicked sensor 101 relative to sensors 103 and 105, there is depicted at FIG. 4 a partial sectional view of the fields of view of sensors 101, 103, 105 and 107 of flame detection apparatus 100. At close range, sensors 101, 103, 105 and 107 have respective fields of view 125, 127, 129 and 131. Because of the placement of sensor 107 away from sensor 101 relative to sensors 103 and 105, FOV 131 overlaps less of FOV 125 than FOVs 127 and 129 of sensors 103 and 105. Thus, when an object 133, such as a cigarette, is located within fields of view 125, 127, 129 and 131 at this range, object 133 is less likely to be observed in its entirety by both sensors 101 and 107 than being observed in its entirety by sensor 101 and sensor 103 or 105.

Specifically, for example, in FIG. 4, object 133 is located completely within field of view 125 of mimicked sensor 101 and field of view 129 of sensor 105 but only partially within the fields of view 127 of sensor 103. In this instance, sensors 101 and 105 will signal to processor 111 information that is skewed in relation to sensor 103 since sensor 103 observes only a portion of object 133 while sensors 101 and 105 observe object 133 in its entirety. This misinformation can cause processor 111 to trigger a false alarm. However, by allowing processor 111 to analyze a second set of signals transmitted by sensor 103, 105 and 107, processor 111 can determine whether object 23 is an actual fire event, or only a small radiation source that is not in need of extinguishing by either comparing the first output of processor 111 to its second output or comparing both processor outputs to a predetermined flame-presence criteria. Thus, as explained in more detail below, by providing operationally redundant sensor 107 and positioning it in this manner relative to sensors 101, 103 and 105, the detection algorithm executed by processor 111 is allowed to receive data about object 133 from spatially separated sensors 101 and 107, which, because of their separation, are better situated to provide to processor 111 contradictory data about object 133 than if sensor 107 was located nearer to sensor 101 than sensors 103 and 105.

Figure 5:
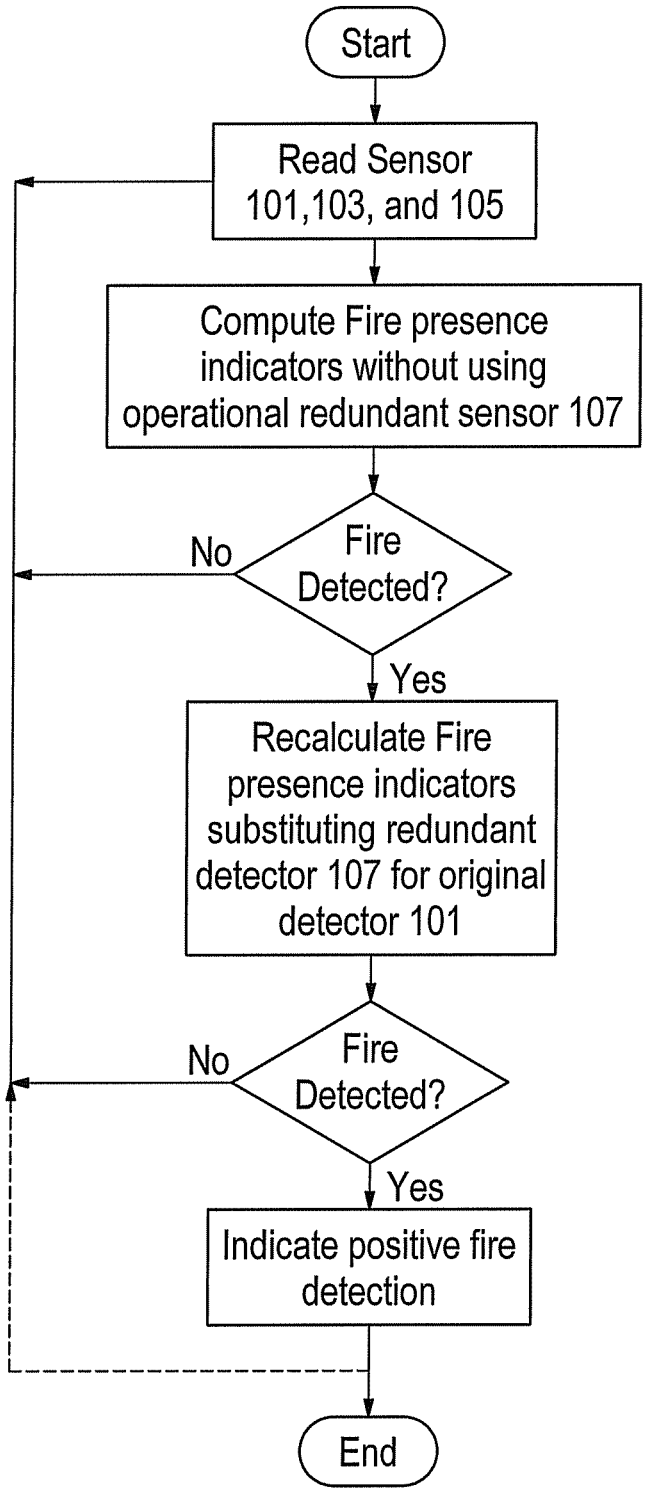
FIG. 5 is a data flow diagram depicting the process by which the optical detector apparatus of FIG. 2 detects the presence of fire.

The detection algorithm executed by the computer program of the present invention is substantially the same as the detection algorithm in current fire detection systems with the exception that when a flame is detected, the algorithm of flame detection apparatus 100 performs calculations twice, once including only the signals of sensors 101, 103 and 105 and once more including only the signals of sensors 103, 105 and 107. More particularly, referring to FIG. 5, upon the detection of a flame by sensors 101, 103, 105 and 107, the algorithm of flame detection apparatus 100 receives and analyzes signals transmitted by sensors 101, 103 and 105 only. Based upon these signals, the algorithm calculates a first output and compares the output to a predetermined flame-presence criteria to determine whether the first output satisfies the predetermined flame-presence criteria for indicating a fire event. When no fire event is indicated by the first output of the algorithm, no instructions are sent to the fire extinguishing system instructing the fire extinguishing system to trigger. However, if the first output of the algorithm satisfies the predetermined flame-presence criteria, the algorithm of flame detection apparatus 100 is configured to receive and analyze the signals transmitted by sensors 103, 105 and 107 only. Based upon these signals, the algorithm calculates a second output and compares the output to the predetermined flame-presence criteria to determine whether the second output satisfies the predeteimined flame-presence criteria for indicating a fire event. When no fire event is indicated by the second output of the algorithm, no instructions are sent to the fire extinguishing system instructing the fire extinguishing system to trigger. Only when the second output of the algorithm indicates a fire event does the algorithm cause instructions to be sent to the fire extinguishing system instructing the fire extinguishing system to trigger.

In an alternative embodiment, rather than compare the first and second outputs to a predetermined fire-presence criteria, the first output of the algorithm is compared to the second output of the algorithm. In this instance, the second output of the algorithm must be within a predetermined percentage, e.g., 5%, of the first output for an alarm to be reported to the fire extinguishing system. Otherwise, no instructions are sent to the extinguishing system. This allows for the fact that some algorithms have a range over which the algorithm output is defined as a fire.

EXAMPLES

A fire detection system having an operationally redundant flame sensor is described where the redundant flame sensor is structurally different from but substantially similar in performance to the flame sensor it mimics. In particular, the fire detection system includes three optical flame sensors. One of these sensors is chosen to be mimicked by a fourth optical flame sensor. In theory, any one of the three flame sensors could be chosen to be mimicked. However, it is preferred that the flame sensor that, in general, has the highest signal to noise ratio is mimicked. This flame sensor can be mimicked using various approaches that are functionally different and then implementing some form of compensation to make the operationally redundant flame sensor operate in a substantially similar fashion to the flame sensor chosen for mimicry.

In this manner, a Geiger-Mueller sensor and a UV-enhanced Silicon sensor, or a Lead-Selenide sensor and a thermopile sensor could be made operationally redundant with the use of appropriate filters and/or electronic circuits and/or software algorithms that correct for any operational difference. Although the particular performance of the two flame sensors would be somewhat different in terms of their detectivity (D*), signal to noise ratio, and noise equivalent power, the two would operate over the same wavelength and give nearly the same output in the presence of a flame when used with the corrective filters, circuits, and/or algorithms.

Having given an example of two operationally redundant flame sensors that are functionally different, examples of how the flame sensors could be used to reject a false alarm are provided. In the first method, one operationally redundant flame sensor is considered to be the primary flame sensor while the other is considered to be the secondary sensor. Assuming multiple sensors, the flame-presence criteria are calculated without using the secondary operationally redundant flame sensor. If the criteria are satisfied, the criteria are calculated a second time without using the primary operationally redundant flame sensor, substituting the secondary flame sensor for the primary flame sensor. If the flame-presence criteria are confirmed in both cases, a fire alarm is announced.

In the second method, the calculations for the flame-presence criteria are performed using the primary operationally redundant flame sensor. Rather than go through the same calculations a second time, the primary and secondary operationally redundant flame sensors are simply compared to each other. A second flame-presence criteria is computed, which may be a simple ratio between the primary and secondary operationally redundant flame sensors, and if the second flame-presence criteria is satisfied subsequent to the first flame-presence criteria then a fire is announced. In both methods, any corrective filters, circuit, and/or algorithms are assumed to be in place so that the exact method of correction is not important.

As will be apparent to one skilled in the art, various modifications can be made within the scope of the aforesaid description. Such modifications being within the ability of one skilled in the art form a part of the present invention and are embraced by the claims below.

It is claimed:

1. A system for discriminating between a fire event and a false fire event comprising, a first radiation detecting structure having a first field of view and configured for transmitting a first signal that is generated in response to detection of a potential fire event by the first radiation detecting structure, a second radiation detecting structure having a second field of view and being operationally redundant to the first radiation detecting structure and configured for transmitting a second signal that is generated in response to detection of the potential fire event by the second radiation detecting structure, and an electronic assembly configured for (i) receiving the first signal and at least one other signal generated in response to detection of the potential fire event and calculating a first output based thereon, (ii) determining whether the first output satisfies a first predetermined flame-presence criteria for indicating a fire event, (iii) receiving the second signal and calculating a second output based on the second signal and the at least one other signal, (iv) determining whether the second output satisfies a second predetermined flame-presence criteria for indicating a fire event, and (v) transmitting a fire alarm command signal to a fire extinguishing system when both the first output satisfies the first predetermined flame-presence criteria and the second output satisfies the second predetermined flame-presence criteria, wherein the first field of view and the second field of view overlap and the first radiation detecting structure and the second radiation detecting structure are supported within a dedicated housing.

2. The flame detection system according to claim 1 wherein the electronic assembly is further configured for refraining from transmitting the fire alarm command signal to the fire extinguishing system when the first output satisfies the first predetermined flame-presence criteria but the second output does not satisfy the second predetermined flame-presence criteria.

3. The flame detection system according to claim 1 further comprising a third radiation detecting structure configured for transmitting a third signal generated in response to detection of the potential fire event by the third radiation detecting structure, wherein the at least one other signal includes the third signal and the third radiation detecting structure is operationally different from the first radiation detecting structure.

4. The flame detection system according to claim 3 further comprising a fourth radiation detecting structure configured for transmitting a fourth signal generated in response to detection of the potential fire event by the fourth radiation detecting structure, wherein the at least one other signal includes the fourth signal and the fourth radiation detecting structure is operationally different from the first radiation detecting structure and the third radiation detecting structure.

5. The flame detection system according to claim 4 wherein each of the first, the second, the third and the fourth radiation detecting structures is selected from the group consisting of an ultraviolet band spectra sensor, a visible band spectra sensor, a near band infrared spectra sensor, a mid band infrared spectra sensor, a far band infrared spectra sensor, a water band spectra sensor, and a carbon dioxide band spectra sensor.

6. The flame detection system according to claim 3 wherein the first, the second and the third radiation detecting structures are housed within the dedicated enclosure and the first radiation detecting structure is positioned nearer to the third radiation detecting structure than to the second radiation detecting structure.

7. The flame detection system according to claim 4 wherein the first, the second, the third and the fourth radiation detecting structures are housed within the dedicated enclosure and the first radiation detecting structure is positioned nearer to the third and the fourth radiation detecting structures than to the second radiation detecting structure.

8. The flame detection system according to claim 1 wherein the first and the second predetermined flame-presence criteria are essentially the same.

9. A method for discriminating between a fire event and a false fire event in a monitored region comprising, positioning a plurality of flame sensors within the monitored region, wherein the plurality of flame sensors is supported within a dedicated housing and includes a first flame sensor, a second flame sensor that is operationally redundant to the first flame sensor and a third flame sensor that is operationally different from the first flame sensor, the first flame sensor having a first field of view that overlaps a second field of view of the second flame sensor and a third field of view of the third flame sensor that overlaps the first field of view and the second field of view, transmitting signals from the plurality of flame sensors to an electronic assembly upon detection by the plurality of flame sensors of a potential fire event, and calculating a first output and a second output based upon the signals, wherein the first output is calculated using a first signal transmitted by the first flame sensor and a third signal transmitted by the third flame sensor absent a second signal transmitted by the second flame sensor, and the second output is calculated using the second signal and the third signal absent the first signal, and refraining from transmitting the fire alarm command signal to a fire extinguishing system when the first output satisfies and the second output fails to satisfy a set of predetermined flame-presence criteria.

10. The method according to claim 9 wherein the first output and the second output are calculated using essentially the same algorithm.

11. The method according to claim 9 further comprising transmitting a fire alarm command signal to the fire extinguishing system when both the first output and the second output satisfy the set of predetermined flame-presence criteria.

12. The method according to claim 9 wherein the monitored region is the passenger compartment of a motor vehicle.

13. The method according to claim 9 wherein the plurality of flame sensors are selected from the group consisting of an ultraviolet band spectra sensor, a visible band spectra sensor, a near band infrared spectra sensor, a mid band infrared spectra sensor, a far band infrared spectra sensor, a water band spectra sensor, and a carbon dioxide band spectra sensor.

14. The method according to claim 9 further comprising arranging the plurality of flame sensors so that the first flame sensor is spaced farther from the second flame sensor than it is spaced from the third flame sensor.

15. The method according to claim 9 wherein the plurality of flame sensors includes a visible band spectra sensor, an infrared band spectra sensor, and an ultraviolet band spectra sensor and the second flame sensor is selected from the group consisting of a visible band spectra sensor, an infrared band spectra sensor an ultraviolet band spectra sensor.

16. The method according to claim 9 further comprising transmitting a fire alarm to a fire extinguishing system when the second output is within a predetermined range of the first output.

17. A method of making a system for discriminating between a fire event and a false fire event comprising, operatively coupling a plurality of flame sensors to an electronic assembly, configuring a first sensor of the plurality of flame sensors to be operationally redundant to a second sensor of the plurality of flame sensors, configuring a third sensor of the plurality of flame sensors to be operationally different from the first sensor, and configuring the electronic assembly for (i) receiving and analyzing signals generated by the plurality of flame sensors upon detection thereby of a potential fire event, (ii) calculating a first output using a first signal transmitted by the first sensor and a third signal transmitted by the third sensor absent a second signal transmitted by the second sensor, (iii) calculating a second output using the second signal and the third signal absent the first signal, (iii) transmitting a fire alarm command signal to a fire extinguishing system when the first output and the second output indicate a fire event, and (iv) refraining from transmitting the fire alarm command signal to the fire extinguishing system when the first output indicates a fire event and the second output does not, wherein the first sensor has a first field of view that overlaps a second field of view of the second sensor and the first sensor, the second sensor and the third sensor are supported within a dedicated housing.

18. The method according to claim 17 wherein the plurality of flame sensors further include a fourth sensor, being operationally different from the first sensor and the third sensor.

19. The method according to claim 17 further comprising positioning the plurality of radiation detectors within a monitored region.

20. The flame detection system according to claim 3 wherein the third radiation detecting structure has a third field of view that overlaps the first field of view and the second field of view.

21. The flame detection system according to claim 4 wherein the fourth radiation detecting structure includes a fourth field of view that overlaps the first field of view, the second field of view and the third field of view.

* * * * *